US006102532A

United States Patent [19]

Horinouchi

[11] Patent Number: 6,102,532

[45] Date of Patent: Aug. 15, 2000

[54] INK RESERVOIR

[75] Inventor: Takashi Horinouchi, Aichi, Japan

[73] Assignee: Inoac Corporation, Aichi, Japan

[21] Appl. No.: 08/733,181

[22] Filed: Oct. 17, 1996

[51] Int. Cl.[7] ..... B41J 2/175

[52] U.S. Cl. ..... 347/86; 347/85

[58] Field of Search ..... 347/85, 86, 87

[56] References Cited

U.S. PATENT DOCUMENTS

| | | | |
|---|---|---|---|
| 4,094,827 | 6/1978 | McEntire | 260/2.5 |
| 4,331,555 | 5/1982 | Baskent et al. | 252/351 |
| 4,386,983 | 6/1983 | Hipchen et al. | 156/79 |
| 4,771,295 | 9/1988 | Baker et al. . | |
| 4,918,210 | 4/1990 | Fenton et al. | 556/425 |
| 5,025,271 | 6/1991 | Baker et al. . | |
| 5,026,489 | 6/1991 | Snow et al. | 252/8.8 |
| 5,248,703 | 9/1993 | Krueger et al. | 521/125 |
| 5,319,841 | 6/1994 | Yata et al. . | |
| 5,369,429 | 11/1994 | Erickson . | |
| 5,387,618 | 2/1995 | Smits | 521/131 |
| 5,467,117 | 11/1995 | Evans et al. . | |
| 5,587,731 | 12/1996 | Yasunaga et al. | 347/86 |

FOREIGN PATENT DOCUMENTS

| | | |
|---|---|---|
| 63-87242 | 4/1988 | Japan . |
| 4355155 | 12/1992 | Japan . |
| 4357046 | 12/1992 | Japan . |
| 538816 | 2/1993 | Japan . |
| 615840 | 1/1994 | Japan . |
| 6107836 | 4/1994 | Japan . |
| 699585 | 4/1994 | Japan . |
| 732613 | 2/1995 | Japan . |
| 7242761 | 9/1995 | Japan . |
| 7329313 | 12/1995 | Japan . |
| 827297 | 1/1996 | Japan . |

*Primary Examiner*—John Barlow
*Assistant Examiner*—Christine Annick
*Attorney, Agent, or Firm*—Sughrue, Mion, Zinn, Macpeak & Seas, PLLC

[57] ABSTRACT

The present invention provides an ink reservoir which gives little reduction of print quality even after a prolonged use and is rigid and flexible enough to te packed into the ink cartridge with ease and maintains a good capacity of reserving an ink over an extended period of time because of an effective networking treatment achieved without heat compression. A novel ink reservoir made of polyurethane for use in printers is provided, prepared from as formulation at least one polyether polyol having an average hydroxyl value of from 30 to 200 mgKOH/g and a foam stabilizer having a surface tension of from 25 to 45 dyne/cm in the form of 1% aqueous solution.

14 Claims, No Drawings

INK RESERVOIR

FIELD OF THE INVENTION

The present invention relates to an ink reservoir made of a polyurethane foam (hereinafter referred to as "foam"). The ink reservoir according to the present; invention can be used as an ink reservoir for reserving an ink to be supplied into a printing head for ink jet printer, etc.

BACKGROUND OF THE INVENTION

In ink jet printers, copying machines, facsimile, etc., an ink reservoir made of a polyurethane foam packed in an ink cartridge made of a thermoplastic resin is used in order to smoothly supply an ink (as disclosed in JP-A-5-38816 (The term "JP-A" as used herein means an "unexamined published Japanese patent application")). The above cited publication discloses a three-dimensional network foam freed of foam cell membrane as a particularly preferred form of polyurethane foam. As a method for removing a foam membrane from a polyurethane foam there are disclosed a method which comprises dipping the polyurethane foam in an alkaline aqueous solution and a so-called explosion method which comprises setting the polyurethane foam in a pressure container, charging explosive gas like a mixture of hydrogen and oxygen and igniting in the mixture to remain only connecting strands of a coarse open-cell foam.

The three-dimensional network thus obtained by the three-dimensional networking treatment which comprises the removal of a cell membrane has a large volume void capable of reserving an ink and a small permanent compression set and thus exhibits a higher ink retention and a higher capability of maintaining its shape in the ink cartridge than other porous materials. Accordingly, even after a prolonged use, the three-dimensional network produces little space in the cartridge due to foam shrinkage, deformation, etc. and thus can supply a required amount of an ink as necessary.

However, a polyurethane foam which can decompose when acted on by water or a water-soluble solvent contained in an ink, such as ester-based foam is disadvantageous in that the decomposition product deteriorates the ink or lowers the surface tension of the ink, causing the printed ink to run. Further, foam pieces formed by decomposition can clog the ink feed opening.

On the other hand, an ether-based foam undergoes no decomposition due to a solvent contained in an ink but is disadvantageous in that unreacted components in the foam can elute with an ink to lower the surface tension of the ink, causing the printed ink to run.

Further, in order to pack an ink reservoir in the ink cartridge, the foam constituting the ink reservoir needs to have a proper rigidity and flexibility. After packed in the ink cartridge, the foam needs to maintain its original shape and hence produces no space in the ink cartridge. However, soft foams which have been frequently used have a deteriorated workability during packing because of excessive flexibility. Further, these foams leave much to be desired in the maintenance of shape.

SUMMARY OF THE INVENTION

It is therefore an object of the present invention to solve the foregoing disadvantages of the conventional ink reservoir.

It is another object of the present invention to provide an ink reservoir which gives little reduction of print quality even after a prolonged use and is rigid and flexible enough to be packed into the ink cartridge with ease and maintains a good capacity of reserving an ink over an extended period of time because of an effective networking treatment achieved with out heat compression.

The foregoing objects of the present invention will become more apparent from the following detailed description and examples.

Paying their attention to the fact that after a prolonged contact with an ink reservoir an ink is susceptible to reduction of surface tension that causes a print quality poor and one of components constituting the formulation for ink reservoir which drastically affect the surface tension of an ink is a foam stabilizer, the inventors have worked out the present invention. In other words, the incorporation of a foam stabilizer having a high surface tension in semirigid foam-compounded formulation can inhibit the reduction of the surface tension of an ink due to elution of the foam components and hence produce a foam that can form a high performance ink reservoir which does not cause the printed ink to run.

DETAILED DESCRIPTION OF THE INVENTION

The first aspect of the present invention is an ink reservoir made of a polyurethane foam obtained by the reaction of a polyisocyanate component with a polyol component containing at least a polyether polyol and a foam stabilizer, characterized in that the average hydroxyl value of the plurality of polyols containing said polyether polyol is from 30 to 200 and the surface tension of said foam stabilizer in the form of 1% aqueous solution is from 25 to 45.

The foregoing polyether polyol can be obtained by the block or random addition polymerization of an initiator having two or more active hydrogens with an alkylene oxide in the presence of a basic catalyst.

Examples of such a polyether polyol include those obtained by the addition of an oxide such as ethylene oxide, propylene oxide, trimethylene oxide, butylene oxide, styrene oxide, α-methyltrimethylene oxide and 3,3'-dimethyltrimethylene oxide to an active hydrogen compound such as propylene glycol, dipropylene glycol, ethylene glycol, glycerol, trimethylol propane, pentaerythritol, sorbitol, sucrose, saccharose, aliphatic amine (e.g., ethylenediamine) and aromatic amine (e.g., tolylenediamine), and so-called polymer polyol obtained by the graft polymerization of such a kind of polyether with acrylonitrile, styrene or the like.

Examples of trivalent initiator include glycerol, trimethylolpropane, 1,2,6-hexanetriol, and triethanolamine. Examples of tetravalent initiator include pentaerythritol, diglycerol, tetramethylolcyclohexane, ethylenediamine, toluenediamine, and methyl glucoside. Examples of pentavalent initiator include 2,2,6,6-tetrakis(hydroxymethyl) cyclohexanol, and diethylenetriamine. Examples of hexavalent initiator include sorbitol, and mannitol. Examples of octavalent initiator include sucrose. It is normally preferred that a tetrafunctional or higher functional polyol which is frequently used in the production of rigid foam be used at least partly in the present invention.

In the present invention, it is desirable that a polyfunctional polyol having an increased addition amount of an alkylene oxide suitable for the production of soft foam is partly added to a semi-rigid foam compound.

These polyols may be used singly or in admixture of two or more. These polyols, if used in admixture, may have an average hydroxyl value of from 30 to 200 as determined by the following equation. The average hydroxyl value is preferably from 120 to 180, and more preferably from 130 to 170. Each of these polyols may have a hydroxyl value deviating from the above defined range.

$$(OHa \times WTa + OHb \times WTb + \ldots + OHn \times WTn)/(WTa + WTb + \ldots + WTn)$$

wherein OHa represents the hydroxyl value of polyol a; WTa represents the added weight of polyol a; OHb represents the hydroxyl value of polyol b; WTb represents the added weight of polyol b; OHn represents the hydroxyl value of polyol n; and WTn represents the added weight of polyol n. That is, if a plurality of polyols are used, the product of the hydroxyl value and the weight fraction of these polyol components may be summed up to thereby obtain an average hydroxyl value.

The use of such a polyol eliminates the fear of deterioration of ink reservoir regardless of if the ink component is alkaline or acidic.

If the average hydroxyl value of the polyol falls below 30, the polyol has too high a molecular weight and hence too high a viscosity, possibly causing some troubles in the production process. Further, such a polyol has too low a reactivity to produce a normal foam. Even if a foam can be obtained, it is so soft that it has a deteriorated work-ability during packing in the ink cartridge in the form of ink reservoir.

On the contrary, if the average hydroxyl value of the polyol exceeds 200, the polyol components give too high a crosslink density and hence produces too rigid a foam. Further, the polyol components cannot give a uniform cross-linked structure and hence cannot produce a normal foam.

As the foregoing isocyanate there may be used an aromatic isocyanate such as toluene diisocyanate (TDI), pure diphenylmethane diisocyanate (P-MDI), polymeric MDI, naphthalene diisocyanate (NDI), 3,3'-ditolylene 4,4'-diisocyanate (TODI), xylene diisocyanate (XDI) and tetramethylxylene diisocyanate (TMXDI), an aliphatic isocyanate such as 1,6-hexamethylene diisocyanate (HDI), isophorone diisocyanate (IPDI), lysine diisocyanate (LDI), xylene diisocyanate hydride (hydrogenated XDI) and cyclohexane diisocyanate (CHDI) or modification product thereof. Particularly preferred among these isocyanates are TDI, MDI, and modification product thereof.

In the present invention, the isocyanate index (percentage of the ratio of the equivalent of isocyanate to the hydroxyl value of polyol) is defined to a rancfe of from 110 to 150. If the isocyanate index is raised so high that the reaction can proceed thoroughly, the content of unreacted monomers, initiator of polyol, adducts and oligomers in the resulting foam can be minimized, preventing the unreacted monomers from being eluted with an ink during the use of the ink reservoir and hence inhibiting the reduction of the surface tension of the ink.

If the isocyanate index falls below the lower limit, much oligomers are contained in the resulting foam besides the unreacted monomers. These oligomers and unreacted monomers can be eluted with the ink during the use of the ink reservoir, causing the reduction of the surface tension of the ink.

On the contrary, if the isocyanate index exceeds the upper limit, a desirable foam cannot be normally obtained. More preferably, the isocyanate index is from about 120 to 130 to provide an optimum foam for ink reservoir.

As the foregoing foam stabilizer there may be normally used a surface active agent for use in the production of polyurethane foam. In particular, a cyclic polydimethyl siloxane, alkyl-modified silicone oil or amino-modified silicone oil may be used. More preferably, a silicone polyether copolymer, i.e., dimethyl siloxane-polyoxy alkylene copolymer is used.

A dimethyl siloxane-polyoxy alkylene copolymer is a nonionic surface active agent having a dimethyl siloxane as a lipophilic group and a polyoxy alkylene moiety as a hydrophilic group. The structure, composition and polymerization degree of the lipophilic group and hydrophilic group may be changed.

The dimethyl siloxane-polyoxy alkylene copolymer to be used in the present invention has the following structure.

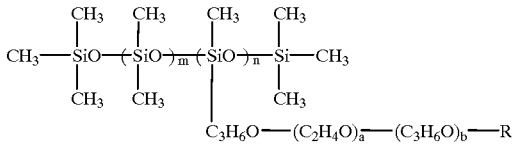

wherein the terminal atomic group R represents a methoxy group, an alkyl group having not more than 4 carbon atoms or a hydrogen atom; a and b each represents an integer; and m and n each represents an integer, with the proviso that the sum of m and n is from 10 to 100.

The surface tension of such a foam stabilizer in the form of 1 wt-% aqueous solution is preferably from 25 to 45 dyne/cm, and more preferably from 28 to 34 dyne/cm. If the surface tension of the foam stabilizer falls within the above defined range, the reduction of the surface tension of the ink can be minimized. A foam stabilizer having a surface tension greater than 45 dyne/cm in the form of 1 wt-% aqueous solution cannot exert a sufficient effect of stabilizing foam and thus is normally not used in the art of polyurethane foam. This is because such a foam stabilizer has an insufficient compatibility with the material mixture and cannot exert a sufficient effect of cell wall resilience.

In the present invention, the foam stabilizer is preferably added in an amount of from 0.5 to 2.0 parts by weight based on 100 parts by weight of the polyol. The amount of the foam stabilizer is more preferably from 1.0 to 1.5 part.

Examples of compounding ingredients of the foregoing polyurethane foam other than the foregoing components include amine and metal-organic catalysts, a known polyurethane plasticizer (e.g., dioctyl phthalate (DOP), dibutyl phthalate (DBP), trioctyl phosphate (TOP), tricresyl phosphate (TCP)), a blowing agent (e.g., water, hydroxychlorofluorocearbon, air, nitrogen gas, pentane, methylene chloride, nitroalkane, formic acid), and a fire retardant (e.g., phosphoric halide). A compatibilizer and a cell opener (e.g., solfonated sodium ricinoleate, polyether siloxane) are used.

The equivalent ratio of isocyanate group to hydroxyl group (isocyanate index) of the reaction mixture is defined to a range of from 110 to 150, which is higher than that of ordinary polyurethane foam.

The foam for ink reservoir of the present invention is characterized in that the surface tension of water in which it has been dipped is from 57 to 70.5 dyne/cm, and preferably from 57 to 64 dyne/cm.

As the water there is used ion-exchanged water. The foam is dipped in the water in an amount of 1 part by weight based on 40 parts by weight of the water. The water temperature is 70° C. The foam is dipped in the water for 6 days (144 hours). The initial surface tension of the water used is 70.5 dyne/cm.

Further, semi-rigid polyurethane foam material is preferably used as an ink reservoir. The present invention is characterized by the use of such a semi-rigid material that exhibits an excellent recovery from deformation and a high energy absorption upon impact.

In order to attain characteristics of semi-rigid foam, a primary hydroxyl group-terminated polyether polyol having a molecular weight of from 1,000 to 6,000 and a polyfunctional amine-terminated chain extender having a hydroxyl value of from 450 to 500 are preferably used. A primary hydroxyl group-terminated polyether polyol having a molecular weight of from 1,000 to 3,000 and a polyfunctional amine-terminated chain extender having a hydroxyl value of from 450 to 500 are more preferably used.

The rigidity of the foam for use in the present invention is preferably from 20 to 40 kgf, more preferably from 25 to 35 kgf, according to JIS K6401-1980. A semi-rigid foam having a rigidity falling within this range can be easily packed in the ink cartridge.

Further, a foam from which a cell membrane has been removed by a networking treatment is desirable. This networking treatment is important particularly in the case of semi-rigid foam.

Examples of the networking treatment include a chemical process which comprises dipping the material in an alkaline aqueous solution, and a physical process which comprises charging a hot-meltable foam in a pressure vessel, and then igniting an explosive gas such as mixture of hydrogen and oxygen to momentarily remove a cell membrane from the foam. In general, the latter is employed. This networking treatment produces a three-dimensional network foam freed of cell membrane. The resulting product can be suitably used as a material for reserving an ink.

The present invention will be further described in the following examples, but the present invention should not be construed as being limited thereto.

(1) Compounding of Foam Materials

Table 1 shows the compounding ingredients of the foam materials used in examples and comparative examples and the amount thereof. These compounding ingredients will be further described below. The amount of foam stabilizer set forth in Table 1 is represented by parts by weight based on 100 parts by weight of the polyol component.

1) Polyol a) EX850, available from Asahi Glass Co., Ltd. (hydroxyl value: 24)

b) GP3000, available from Sanyo Chemical Industries, Ltd. (hydroxyl value: 56; average number of functional groups: 3) (propylene oxide adduct prepared from glycerol as an initiator)

c) FA311-50, available from Sanyo Chemical Industries, Ltd. (hydroxyl value: 48)

d) L27, available from Takeda Chemical Industries, Ltd. (hydroxyl value: 58)

e) V3940, available from Mitsubishi Kasei Dow Co., Ltd. (hydroxyl value: 30)

f) SP50-01, available from Shell Japan Co., Ltd. (hydroxyl value: 50)

g) GS18A, available from Takeda Chemical Industries, Ltd. (hydroxyl value: 80) (polyol having a hydroxyl value of 80 obtained by mixing a propylene oxide-added polyol prepared from glycerol as an initiator (number of functional groups: 3; hydroxyl value: 56), a polyol suitable for rigid foam having four or more functional groups and an aromatic amine crosslinking agent)

h) GS18B, available from Takeda Chemical Industries, Ltd. (propylene oxide adduct prepared from sucrose and glycerol as initiators)

When GS18A and GS18B are mixed in a proportion of 85:15, a polyol having an average hydroxyl value of 137 and 3.44 functional groups on the average is obtained.

i) GS19, available from Takeda Chemical Industries, Ltd. (hydroxyl value: 170)

j) EX420, available from Asahi Glass Co., Ltd. (hydroxyl value: 280)

k) ACTCALL H39, available from Takeda Chemical Industries, Ltd. (hydroxyl value: 49; average number of functional groups: 4) (propylene oxide adduct prepared from sucrose as a initiator)

2) Foam Stabilizer a) L540, available from Nippon Unicar Company Limited (surface tension in the form of 1% aqueous solution: 21 dyne/cm)

b) L1656, available from Nippon Unicar Company Limited (surface tension in the form of 1% aqueous solution: 21 dyne/cm)

c) F112, available from Shin-Etsu Chemical Co., Ltd. (surface tension in the form of 1% aqueous solution: 29 dyne/cm)

d) F114, available from Shin-Etsu Chemical Co., Ltd. (surface tension in the form of 1% aqueous solution: 31 dyne/cm)

e) F342, available from Shin-Etsu Chemical Co., Lid. (surface tension in the form of 1% aqueous solution: 42 dyne/cm)

f) L520, available from Nippon Unicar Company Limited (surface tension in the form of 1% aqueous solution: 47 dyne/cm)

3) Other Components a) Blowing agent: water (standard added amount: 10–3.0 pbw)

b) Amine catalyst: 33% triethylenediamine/dipropylene glycol DABCO33-LV, available from Sankyo Air Product Co., Ltd. (standard added amount: 0.1–0.4 pbw)

c) Tin catalyst: tin octylate, T-9, available from M & T Co., Ltd. (standard added amount: 0.1–0.25 pbw)

4) Polyisocyanate 2,4-Toluenediisocyanate, TDI-80, available from Nippon Polyurethane Industry Co., Ltd.

The foregoing catalyst, blowing agent and foam stabilizer were introduced into a mixing chamber with a premix of the foregoing polyol component and isocyanate component by means of a low pressure pump. The mixture adjusted at 40 to 80° C. was vigorously stirred with a pump at 2,000 to 6,000 r.p.m., discharged, and then cured to obtain a slabstock.

The foam thus obtained was then cut into a 30×30×30 cm piece. The foam was then put in a sealed vessel. The air in the vessel was then replaced by a 1:2 mixture of oxygen and hydrogen at a pressure of $9.8\times10^4$ Pa. The gas was then ignited to network the foam. The degree of networking can be controlled by the pressure of the gas in the vessel (9.8 to $29\times10^4$ Pa). 5 g of the three-dimensional network polyurethane foam thus obtained was then dipped in 200 g of 70° C. water for 6 days. The change of the surface tension of the water from the initial value (70.5 dyne/cm) was then observed.

The surface tension of the water was measured by means of a Type CBVP tensiometer available from Kyowa Interface Science Corporation Limited.

The foams obtained in the various examples and comparative examples were each pressed into the ink reservoir cartridge of an ink jet printer. The foams were each visually observed for the occurrence of wrinkle, burr, etc. These results were evaluated to determine packability. G (Good) indicates that the foam is acceptable. F (Fair) indicates that the foam has little wrinkle or other defects and thus is acceptable for use. P (Poor) indicates that the foam is not acceptable for use.

The ink cartridge thus filled with the ink reservoir was then set in an ink tank containing an aqueous ink so that the ink was absorbed by and reserved in the ink reservoir. The ink cartridge was then allowed to stand in a 60° C. constant temperature bath for 1 month (corresponding to ageing at room temperature for 1 year). The ink cartridge was then mounted in the printer. Printing was actually effected. The occurrence of print running was then observed. The surface tension of the water and the occurrence of print running are set forth in Table 1. The aqueous ink used was an ordinary ink composition comprising water, a water-soluble organic solvent, an additive for adjusting various physical properties, a dye, etc. incorporated therein.

G (Good) in the column of print quality in Table 1 indicates that there occurs substantially no print running. F (Fair) indicates that there occurs some but acceptable print running. P (Poor) indicates that there occurs so significant print running that the foam cannot be used as an ink reservoir.

For the measurement of rigidity according to JIS K6401-1980, a 50×300×300 mm specimen was prepared. The specimen was then pressed under a load of 4.9 N. The thickness of the specimen thus attained was used as a reference. The specimen was compressed to 75% of the reference thickness. The specimen was immediately allowed to recover. The specimen was then compressed by 25% of the reference thickness. The load required to keep this condition after 20 seconds was then measured to determine rigidity.

Table 1 shows that in Comparative Examples 1 to 4, the water in which the foams had been dipped exhibited a surface tension of not more than 56 dyne/cm, and the resulting print qualities were poor and thus the foams were not acceptable for use. In Examples 1 to 8, the water in which the foams had been dipped exhibited a surface tension of from 57 to 64 dyne/cm, and the resulting print quality was fair or good and thus the foams could be used as an ink reservoir.

In particular, in Example 4, which comprised the use of a foam stabilizer having a surface tension of 31 dyne/cm as determined in the form of 1 wt-% aqueous solution, the water in which the foam had been dipped showed a surface tension as high as 61 dyne/cm. The resulting print quality was excellent.

In Examples 6 and 7, which comprised the use of a foam stabilizer having a surface tension of not less than 31 dyne/cm in the form of 1 wt-% aqueous solution and a polyol having an average hydroxyl value of not less than 80, the water in which the foams had been dipped showed a surface tension as high as 64 and 63 dyne/cm, respectively, and the resulting print quality was excellent. In Example 7, two kinds of polyols having a hydroxyl value of 80 and 460, respectively, were mixed to attain an average hydroxyl value of 137. If the average hydroxyl value falls within the claimed range, there occurs no deterioration of print quality. Further, the resulting ink reservoir could be smoothly packed in the ink cartridge. Example 7 provided the most excellent ink reservoir in the present invention. In Example 8, polyols having a hydroxyl value of 24 and 280 were mixed to attain an average hydroxyl value of 152. It can thus be seen that even both the two polyols deviate from the claimed range with respect to hydroxyl value, the desirable results can be obtained when the average hydroxyl value of the two polyols falls within the claimed range.

TABLE 1

| | Examples | | | | | | | | Comparative Examples | | | |
|---|---|---|---|---|---|---|---|---|---|---|---|---|
| | 1 | 2 | 3 | 4 | 5 | 6 | 7 | 8 | 1 | 2 | 3 | 4 |
| Polyol | | | | | | | | | | | | |
| a) (OH value = 24) | — | — | — | — | — | — | — | 50 | 100 | — | — | — |
| b) (OH value = 56) | — | — | — | 85 | — | — | — | — | — | — | 100 | 100 |
| c) (OH value = 48) | 100 | — | — | — | — | — | — | — | — | — | — | — |
| d) (OH value = 58) | — | 100 | — | — | — | — | — | — | — | — | — | — |
| e) (OH value = 30) | — | — | 100 | 15 | — | — | — | — | — | — | — | — |
| f) (OH value = 50) | — | — | — | — | 100 | — | — | — | — | — | — | — |
| g) (OH value = 80) | — | — | — | — | — | — | 85 | — | — | — | — | — |
| i) (OH value = 170) | — | — | — | — | — | 100 | — | — | — | — | — | — |
| j) (OH value = 280) | — | — | — | — | — | — | — | 50 | — | 100 | — | — |
| h) (OH value = 460) | — | — | — | — | — | — | 15 | — | — | — | — | — |
| Foam stabilizer | | | | | | | | | | | | |
| b) (21 dyne/cm) | 1.0 | — | — | — | — | — | — | — | — | — | 1.0 | — |
| c) (29 dyne/cm) | — | 1.0 | 1.0 | — | 1.0 | — | — | — | 1.0 | — | — | — |
| d) (31 dyne/cm) | — | — | — | 1.0 | — | — | 1.0 | 1.0 | — | — | — | — |
| e) (42 dyne/cm) | — | — | — | — | — | 1.0 | — | — | — | 1.0 | — | — |
| f) (47 dyne/cm) | — | — | — | — | — | — | — | — | — | — | — | 1.0 |
| Isocyanate index | 115 | 115 | 115 | 115 | 115 | 115 | 115 | 115 | 115 | 115 | 115 | 115 |
| Surface tension (dyne/cm) | 59 | 58 | 57 | 61 | 58 | 64 | 63 | 60 | 55 | 56 | 56 | 54 |
| Print quality | G | F | F | G | F | G | G | G | P | P | P | P |

TABLE 2

| | Examples | | | | | Comparative Examples | | | |
|---|---|---|---|---|---|---|---|---|---|
| | 9 | 10 | 11 | 12 | 13 | 5 | 6 | 7 | 8 |
| Polyol | | | | | | | | | |
| b) (OH value = 56, f* = 3) | 100 | 100 | — | — | — | 100 | 100 | — | — |
| k) (OH value = 49, f* = 4) | — | — | 100 | 100 | 100 | — | — | 100 | 100 |
| Foam stabilizer | | | | | | | | | |
| b) (21 dyne/cm) | 1.2 | 1.2 | 1.2 | 1.2 | 1.2 | 1.2 | 1.2 | 1.2 | 1.2 |
| Isocyanate index | 115 | 120 | 110 | 115 | 120 | 155 | 107 | 105 | 160 |
| Surface tension (dyne/cm) | 60 | 63 | 58 | 61 | 64 | 53 | 56 | 55 | — |
| Evaluation of print quality | G | G | F | G | G | — | — | — | — |
| Packability | G | G | G | G | G | P | F | F | — |
| Rigidity | 16.5 | 17.2 | 20.5 | 21.6 | 23.0 | 31.0 | 13.9 | 19.8 | — |

*: average number of functional groups

Examples 9 and 10 and Comparative Examples 5 and 6 show the results of the change of isocyanate index. Comparative Example 5 shows the case where the isocyanate index is high. In Comparative Example 5, the resulting foam had too high a rigidity and too small a flexibility to be packed in the ink cartridge in the form of ink reservoir after the inner shape of the ink cartridge. Thus, print quality was not evaluated. Comparative Example 6 shows the case where the isocyanate index is low. The resulting ink reservoir gave a poor print quality and exhibited a low rigidity.

Examples 11 to 13 show the case where a polyol having 4 functional groups is used. It can be seen that the properties of the ink reservoir depend on the isocyanate index. In Comparative Example 8, the foam was collapsed.

It can be seen in Table 2 that Comparative Example 6, which exhibited an isocyanate index as low as 107 in spite of the use of a trifunctional polyether polyol, was very poor both in packability and print quality. The water in which the ink reservoir had been dipped for a predetermined period of time showed a surface tension as low as 56 dyne/cm.

On the other hand, Example 9, which exhibited an isocyanate index as high as 115 in spite of the use of a trifunctional polyol, provided improvements in the various properties. In particular, Example 10, which exhibited an isocyanate index as high as 120, was excellent both in packability and print quality and showed a drastically enhanced surface tension as 63 dyne/cm.

When a tetrafunctional polyether polyol is used, the resulting foam normally has a high rigidity. Comparative Example 7, which exhibited an isocyanate index as low as 105, showed a higher rigidity than that in Comparative Example 6 but did not give good results in the evaluation of print quality and provided a surface tension as low as 55 dyne/cm.

On the other hand, Example 11, which comprised the use of a tetrafunctional polyol to exhibit an isocyanate index of 110, did not necessarily give a good print quality but gave an excellent packability and surface tension. In particular, Examples 12 and 13, which exhibited an isocyanate index of 115 and 120, respectively, were very excellent both in packability and print quality and provided a higher surface tension than those in Examples 9 and 10.

TABLE 3

| | Example | Comparative Examples | | | |
|---|---|---|---|---|---|
| | 14 | 9 | 10 | 12 | 13 |
| Polyol | | | | | |
| b) (OH value = 56, f* = 3) | — | 100 | 100 | — | — |
| a) (OH value = 24, f* = 4) | 50 | — | — | 100 | 100 |
| j) (OH value = 280, f* = 4) | 50 | — | — | — | — |
| Foam stabilizer | | | | | |
| a) (21 dyne/cm) | — | — | — | 1.0 | — |
| c) (29 dyne/cm) | — | 1.0 | — | — | — |
| d) (31 dyne/cm) | 1.0 | — | — | — | — |
| e) (42 dyne/cm) | — | — | 1.0 | — | — |
| f) (50 dyne/cm) | — | — | — | — | 1.0 |
| Isocyanate index | 110 | 110 | 110 | 110 | 110 |
| Surface tension (dyne/cm) | 59 | 55 | 56 | 56 | — |
| Print quality | G | P | P | P | — |
| Packability | G | F | P | G | — |

*average number of functional groups

Finally, Example 14 comprised the use of a mixture of polyols having a hydroxyl value of 24 and 280 to attain an average hydroxyl value of 152. Both the two polyols deviated from the claimed range with respect to hydroxyl value. It can thus been seen that even if both the two polyols deviate from the claimed range with respect to hydroxyl value, the desirable results can be obtained when the average hydroxyl value of the two polyols falls within the claimed range.

One of the causes to which the deterioration of the print quality by an ink jet printer is attributed is the reduction of the surface tension of the ink. The inventors found that the use of, as a material of ink reservoir, a polyurethane foam which causes water to exhibit a surface tension of not less than a predetermined value after contact under specific conditions results in little deterioration of print quality. In particular, the use of a foam which keeps the surface tension of water to not less than 60 dyne/cm makes it possible to maintain the print quality higher.

Further, the use of a foam stabilizer having a high surface tension as an ingredient of the foam constituting the ink reservoir makes it possible to obtain an ink reservoir which exhibits a good ink retention without causing running of printed ink even after a prolonged use.

Moreover, the selection of a networked semi-rigid foam having a polyfunctional polyol partly incorporated therein makes it possible to obtain an ink reservoir having excellent properties. Such a semi-rigid foam has a suitable compressibility and rigidity suitable for ink reservoir and thus can be smoothly packed in the vessel and perform well as an ink reservoir.

The rise in the isocyanate index during the preparation of a semi-rigid foam makes it possible to obtain a better foam.

The use of a foam stabilizer having a high surface tension can inhibit the reduction of the surface tension of the ink even when the foam stabilizer is eluted with the ink. Further, the reduction of the content of unreacted terminal active groups by increasing the isocyanate index can minimize the content of low molecular components such as unreacted polyol and oligomer remained in the foam, making it possible to inhibit the reduction of the surface tension of the ink caused by the elution of the foam components. Accordingly, a foam can be obtained which forms an excellent ink reservoir which causes no print running.

While the invention has been described in detail and with reference to specific embodiments thereof, it will be apparent to one skilled in the art that various changes and modifications can be made therein without departing from the spirit and scope thereof.

What is claimed is:

1. An ink jet printer reservoir comprising a polyurethane foam obtained by combining at least a polyisocyanate, a polyol component comprising a non-graft polyether polyol, and a foam stabilizer to form a reaction mixture, reacting the reaction mixture to form a polyurethane foam, and curing the foam, wherein said polyether polyol has an average hydroxyl value of from 120 to 180 mg KOH/g, and a 1% aqueous solution of the foam stabilizer has a surface tension of from 25 to 45 dyne/cm.

2. The ink jet printer reservoir according to claim 1, wherein when the polyurethane foam is dipped in water having an initial surface tension of 70.5 dyne/cm, wherein the water is present in an amount of forty (40) times the weight of the polyurethane foam, for six (6) days at a temperature of 70° C., the water exhibits a surface tension of from 57 to 70.5 dyne/cm.

3. The ink jet printer reservoir according to claim 1, wherein the polyurethane foam is a semi-rigid networked foam.

4. The ink jet printer reservoir according to claim 1, wherein the polyurethane foam is a semi-rigid networked foam having a rigidity of from 20 to 40 kgf according to JIS K6401-1980.

5. The ink jet printer reservoir according to claim 2, wherein the polyurethane foam is a semi-rigid networked foam and the foam stabilizer is a dimethyl siloxane-polyoxy alkylene copolymer.

6. The ink jet printer reservoir according to claim 2, wherein the polyurethane foam is a semi-rigid networked foam, the foam stabilizer is a dimethyl siloxane-polyoxy alkylene copolymer, and the isocyanate index of the reaction mixture is from 110 to 150.

7. The ink jet printer reservoir according to claim 2, wherein the polyurethane foam is a semi-rigid networked foam, the foam stabilizer is a dimethyl siloxane-polyoxy alkylene copolymer, the isocyanate index of the reaction mixture is from 110 to 150, and the polyurethane foam has a rigidity of from 20 to 40 kgf according to JIS K6401-1980.

8. The ink jet printer reservoir according to claim 4, wherein the isocyanate index of the polyurethane foam is from 110 to 150, and the polyether polyol has at least four (4) functional groups/mol.

9. The ink jet printer reservoir according to claim 1, wherein said polyether polyol has at least four (4) functional groups per mol.

10. The ink jet printer reservoir according to claim 1, further comprising an ink absorbed into the polyurethane foam.

11. The ink jet printer reservoir according to claim 1, wherein the 1% aqueous solution of the foam stabilizer has a surface tension of from 28 to 34 dyne/cm.

12. The ink jet printer reservoir according to claim 1, wherein the polyether polyol is at least tetrafunctional.

13. An ink jet printer reservoir comprising a polyurethane foam having a non-graft polyether polyol constituent with an average hydroxyl value in the range of 120 to 180 mg KOH/g, wherein when the polyurethane foam is dipped in water having an initial surface tension of 70.5 dyne/cm, wherein the water is present in an amount of forty (40) times the weight of the polyurethane foam, for six (6) days at a temperature of 70° C., the water exhibits a surface tension in the range of 57 to 70.5 dyne/cm.

14. The ink jet printer reservoir according to claim 13, wherein the polyurethane foam is obtained by combining at least a polyisocyanate, the polyether polyol constituent, and a foam stabilizer to form a reaction mixture, reacting the reaction mixture to form a polyurethane foam, and curing the foam, wherein said polyether polyol has an average hydroxyl value of from 30 to 200 mg KOH/g, a 1% aqueous solution of the foam stabilizer has a surface tension of from 25 to 45 dyne/cm, the polyurethane foam is a semi-rigid networked foam, the stabilizer is a dimethyl siloxane-polyoxy alkylene copolymer, and the isocyanate index of the reaction mixture is from 110 to 150.

* * * * *